US009833720B2

(12) United States Patent
Walterscheid

(10) Patent No.: US 9,833,720 B2
(45) Date of Patent: Dec. 5, 2017

(54) CLIP LAUNCHER SYSTEM WITH INTERCONNECTING PROJECTILE

(71) Applicant: KMA Concepts Limited, Kowloon (HK)

(72) Inventor: Steve Walterscheid, Bend, OR (US)

(73) Assignee: KMA Concepts Limited, Tbin Sha Tsui, Kowloon (HK)

( * ) Notice: Subject to any disclaimer, the term of this patent is extended or adjusted under 35 U.S.C. 154(b) by 0 days.

(21) Appl. No.: 14/746,839

(22) Filed: Jun. 22, 2015

(65) Prior Publication Data

US 2016/0367903 A1 Dec. 22, 2016

(51) Int. Cl.

| | |
|---|---|
| ***A63H 13/10*** | (2006.01) |
| ***A63H 17/00*** | (2006.01) |
| *A44B 11/26* | (2006.01) |

(52) U.S. Cl.

CPC ..... *A63H 17/008* (2013.01); *A44B 11/266* (2013.01)

(58) Field of Classification Search

CPC ..... A63H 13/10; A63H 13/16; A63H 13/02; A63H 11/06; Y10T 24/45524; Y10T 24/45529; A44B 11/266

See application file for complete search history.

(56) References Cited

U.S. PATENT DOCUMENTS

| | | | | | |
|---|---|---|---|---|---|
| D30,032 | S | * | 1/1899 | Weigelt et al. | |
| 2,349,984 | A | * | 5/1944 | Ostrander | A63H 13/16 446/310 |
| 4,425,735 | A | * | 1/1984 | Kulesza | A63H 18/028 446/28 |
| 4,800,629 | A | | 1/1989 | Ikeda | |
| 4,934,304 | A | * | 6/1990 | Rosen | B42D 9/005 116/234 |
| 5,141,468 | A | * | 8/1992 | Suzuki | A63H 29/24 446/26 |
| 5,355,562 | A | | 10/1994 | Matoba et al. | |
| D381,936 | S | * | 8/1997 | Anscher | D11/216 |
| D397,641 | S | * | 9/1998 | Hamilton | D11/216 |
| 5,845,376 | A | | 12/1998 | Tung | |

(Continued)

FOREIGN PATENT DOCUMENTS

| | | | |
|---|---|---|---|
| EP | 0648441 | A1 | 4/1995 |
| KR | 2012 0021162 | A | 3/2012 |
| WO | WO/2008/045696 | A2 | 4/2008 |

*Primary Examiner* — Aarti B Berdichevsky
*Assistant Examiner* — Urszula M Cegielnik
(74) *Attorney, Agent, or Firm* — LaMorte & Associates, P.c.

(57) ABSTRACT

A system for launching a toy projectile from a clip connector. The toy projectile has elongated arm elements and elongated leg elements. The toy projectile is launched from a clip connector launcher. The clip connector launcher has a housing with a top opening, side openings, and an internal divider. The elongated arm elements and the elongated leg elements from the toy projectile are inserted into the top opening of the clip connector housing. The elongated arm elements mechanically interlock with the side openings in the clip connector housing when in a fully engaged position. The leg elements are spread by the divider within the clip connector housing when in the fully engaged position. The elongated arm elements and the elongated leg elements store spring energy that releases to accelerate the toy character out and away from the clip connector housing.

13 Claims, 5 Drawing Sheets

(56) References Cited

U.S. PATENT DOCUMENTS

D405,723 S * 2/1999 Anscher ..... D11/216
D405,724 S * 2/1999 Anscher ..... D11/216
6,052,875 A * 4/2000 Fudaki ..... A44B 11/266 24/615
D423,985 S * 5/2000 Yoshiguchi ..... D11/218
D425,443 S * 5/2000 Anscher ..... D11/216
6,073,966 A * 6/2000 Warren ..... A63H 33/38 116/239
D447,980 S * 9/2001 Kawamura ..... D11/216
6,352,048 B1 * 3/2002 Scott ..... B42D 9/004 116/237
6,457,219 B1 * 10/2002 Liu ..... A44B 11/266 24/615
D471,130 S * 3/2003 Lai ..... D11/216
D471,486 S * 3/2003 Uehara ..... D11/216
D473,487 S * 4/2003 Kaneko ..... D11/216
7,020,939 B2 * 4/2006 Anscher ..... A44B 11/266 24/625
D538,197 S * 3/2007 Wemmer ..... D11/216
D563,269 S * 3/2008 Anscher ..... D11/216
7,810,220 B2 * 10/2010 Anthony ..... A01K 27/005 24/599.1
7,927,173 B1 4/2011 Walterscheid
D638,331 S * 5/2011 Paik ..... D11/216
D647,818 S * 11/2011 Kaneko ..... D11/216
9,615,633 B2 * 4/2017 Takahashi ..... A44B 11/266
2002/0062781 A1 * 5/2002 Shannon ..... B42D 9/001 116/234
2003/0121130 A1 * 7/2003 Buscart ..... A44B 11/006 24/615
2005/0198789 A1 * 9/2005 Wang ..... A44B 19/262 24/429
2005/0235470 A1 * 10/2005 Uehara ..... A44B 11/266 24/615
2006/0090310 A1 * 5/2006 Uehara ..... A44B 11/266 24/614
2006/0168783 A1 * 8/2006 Anscher ..... A44B 11/266 24/615
2007/0017074 A1 * 1/2007 Pontaoe ..... A44B 11/266 24/625
2007/0167106 A1 * 7/2007 Hoover ..... A41F 1/002 446/26
2007/0186394 A1 * 8/2007 Hsiao ..... A44B 11/2519 24/614
2008/0134479 A1 * 6/2008 Kolasa ..... A44B 11/266 24/625
2008/0178438 A1 * 7/2008 Yoshie ..... A44B 11/266 24/616
2008/0222860 A1 * 9/2008 Pontaoe ..... A44B 11/006 24/614
2009/0056089 A1 * 3/2009 Yoshie ..... A44B 11/266 24/616
2010/0037437 A1 * 2/2010 Buday ..... A44B 11/266 24/163 K
2011/0173783 A1 * 7/2011 Kaneko ..... A44B 11/266 24/615
2012/0326428 A1 * 12/2012 Stones ..... B42D 9/001 281/42
2013/0160251 A1 * 6/2013 Kawaguchi ..... A44B 11/266 24/594.11
2015/0237971 A1 * 8/2015 Takahashi ..... A44B 11/006 24/197

* cited by examiner

CLIP LAUNCHER SYSTEM WITH INTERCONNECTING PROJECTILE

BACKGROUND OF THE INVENTION

1. Field of the Invention

In general, the present invention relates to the structure of toy projectiles and launchers for toy projectiles. The present invention also relates to the structure of clip connectors and the use of clip connectors as a platform to launch toys.

2. Prior Art Description

Many consumer products, such as backpacks and book bags contain strapping. Commonly, some of the strapping is terminated with clip connectors that enable sections of the strapping to be selectively connected or separated.

Clip connectors have both a male side and a female side that interconnect. The male side of the clip connector contains two elongated arms that deform slightly when they enter the female side of the clip connector. The arms expand into openings within the female side, therein locking the male and female sides of the clip connector together. One early example of such a prior art clip connector is found in U.S. Pat. No. 4,800,629 to Ikeda, entitled Plastic Buckle.

Although many variations of such clip connectors exist in the marketplace, such connectors are used mainly for selectively interconnecting strapping or similar flexible tethers.

Also, in the prior art, there exist many toy cars, motorcycles, airplanes, characters and other such toys that are designed to be launched as projectiles, either on the ground or through the air. Such toys typically require a launching device for accelerating the toy into flight. In the prior art, launching devices typically use compressed springs or pulled elastic bands to provide the energy needed to accelerate and launch the toy into flight. As is often the case, the launching device for a toy projectile is far more complex and expensive than is the toy projectile itself. Consequently, the launcher for a toy projectile, if sold with a toy projectile, can be responsible for most of the cost of the packaged toy.

In U.S. Pat. No. 7,927,173 to Walterscheid, the applicant herein, attempts to create a toy launcher from the structure of a clip connector. In this early design, the energy used to launch the toy projectile forward was generated by connecting the toy projectile to a clip connector and manually squeezing the toy projectile to disengage it from the clip connector. The problem that occurs is that a person's fingers create friction against the flexible arms as they squeeze the flexible arms. This friction inhibits the movement of toy projectile and often adversely affects both the flight velocity and the flight path of the toy projectile.

The applicant has improved his design in such a manner that it negates the adverse effects of finger friction. The result is a toy that moves faster and farther than that in the prior art. The structure of the present invention and its associated method of use are described and claimed below.

SUMMARY OF THE INVENTION

The present invention is a system for launching a toy projectile from a clip connector. The toy projectile has a set of elongated arm elements and a set of elongated leg elements extending therefrom. The toy projectile is launched from a clip connector launcher. The clip connector launcher has a housing with a top opening, side openings and an internal divider. The set of elongated arm elements and the set of elongated leg elements from the toy projectile are insertable into the top opening of said clip connector housing. The set of elongated arm elements mechanically interlock with the side openings in said clip connector housing when in a fully engaged position. The set of leg elements are spread by the divider within the clip connector housing when in the fully engaged position.

The set of elongated arm elements and the set of elongated leg elements store spring energy that releases to accelerate the toy character out and away from the clip connector housing when a force is applied to the set of elongated arm elements through the side openings that displaces the set of elongated arm elements from the side openings. This launches the toy projectile from the clip connector housing at a velocity sufficient to launch the toy projectile into flight.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention can be used to launch many types of toys, such as toy airplanes, toy vehicles, and toy rockets, the present invention is especially well suited for launching a toy character, such as a toy superhero. Accordingly, the exemplary embodiment of the invention selected for illustration is that of a toy character that is intended to be launched into flight. This embodiment is presented as representing the best mode contemplated for the invention. However, the selected embodiment is a mere example and should not be considered a limitation when interpreting the claims.

Figure 1:
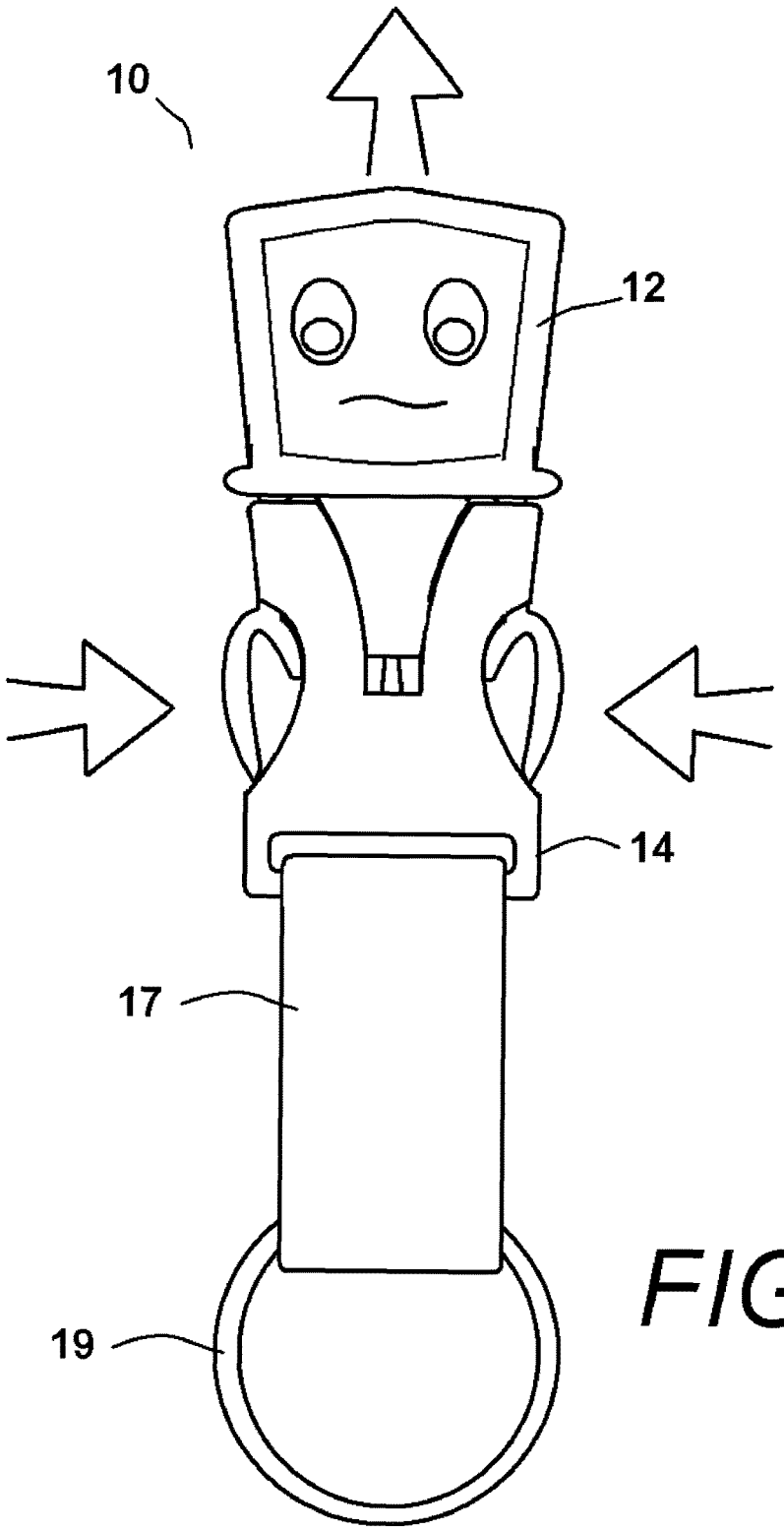
FIG. 1 is a front view of an exemplary embodiment of a toy launching system with a toy projectile and clip base launcher engaged.
Figure 2:
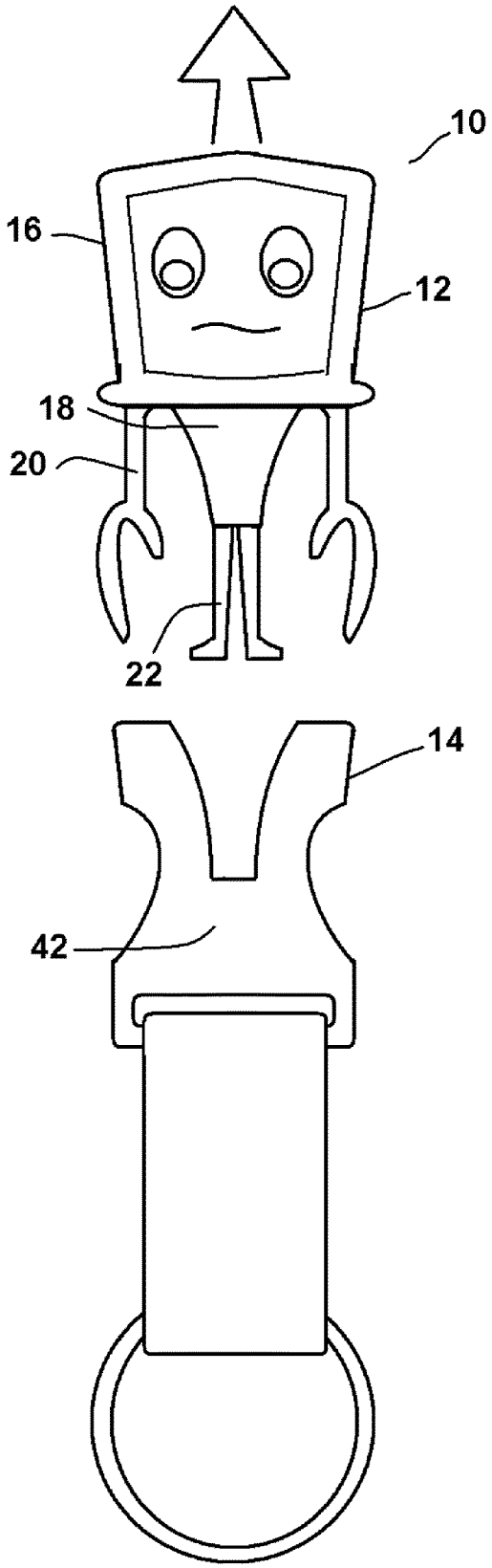
FIG. 2 is a front view of the embodiment of FIG. 1 with the toy projectile and the clip base launcher separated.

Referring to FIG. 1 in conjunction with FIG. 2, an exemplary embodiment of a toy launching system 10 is shown. The toy launching system 10 consists of a toy character 12 and a clip base launcher 14. The toy character 12 is exemplary of many possible toy projectile configurations. As will be explained, the clip base launcher 14 is generally configured as a female half of a traditional clip connector with slight modifications. The clip base launcher 14 can be attached to a strap 17 in the traditional manner of a clip connector. The strap 17 can be attached to any secondary object 19, such as a backpack, key ring, lunch box or the like.

The toy character 12 is configured as a humanoid figure. Accordingly, the toy character 12 has a head 16, a body 18, arm elements 20, and leg elements 22. However, the head 16, body 18, arm elements 20, and leg elements 22 have unique configurations that enable the toy character 12 to interconnect with the clip base launcher 14. The head 16, body 18, arm elements 20, and leg elements 22 also promote the rapid separation and launching of the toy character 12 from the clip base launcher 14.

The toy character 12 is selectively interconnected with the clip base launcher 14. As will be explained, when the arm elements 20 of the toy character 12 are squeezed to disengage the toy character 12 from the clip base launcher 14, the spring energy that is stored within the arm elements 20 and the leg elements 22 of the toy character 12 are simultaneously released. The released energy accelerates the toy character 12 away from the clip base launcher 14, therein launching the toy character 12 into flight.

Figure 3:
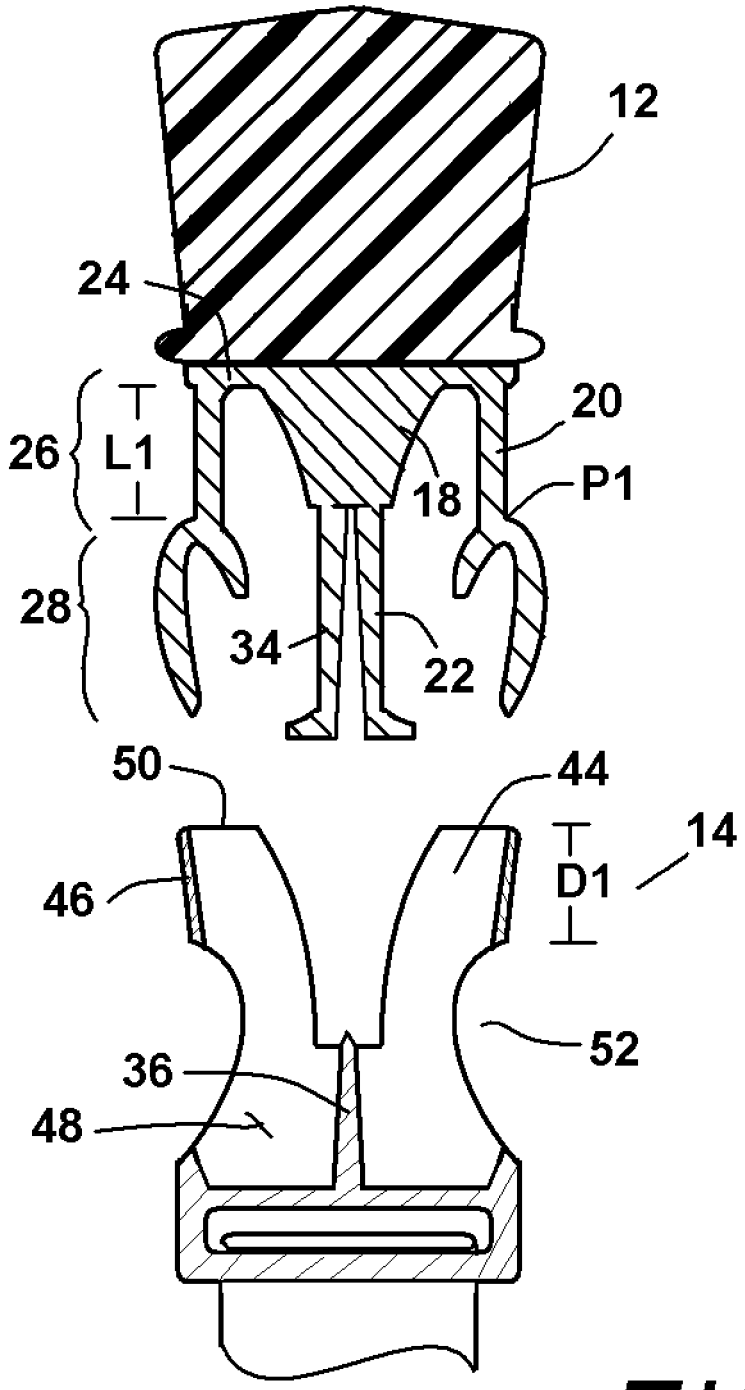
FIG. 3 is a cross-sectional view of the embodiment of FIG. 1.

Referring to FIG. 3 in conjunction with FIG. 1 and FIG. 2, it can be seen that head 16 of the toy character 12 may be hollow to reduce the overall weight of the toy character 12. Alternatively, the head 16 of the toy character 12 can be made from a molded foam rubber, as illustrated, to make the head 12 both lightweight and soft. In either construction, a base support 24 is present at the bottom of the head 16 at the transition between the head 12 and the remainder of the toy character 12, which includes the body 18, arm elements 20, and leg elements 22.

The arm elements 20 extend from the base support 24 as flexible cantilevers. The arm elements 20 are molded from resilient flexible plastic that enables the arm elements 20 to temporarily deform and then spring back to their original shape. Each of the arm elements 20 has a thin section 26 and a wider hand section 28. The thin section 26 has a length L1, the significance of which is later explained. The hand section 28 has a smooth curved surface 30 that bulges outwardly and is wider than the thin section 26. The arm elements 20 on opposite sides of the toy character 12 are mirror images of each other. On both arm elements 20, there is a distinct transition point P1 between the straight thin section 26 and the bulge of the smooth curved surface 30 that is the exterior of the hand section 28.

The body 18 extends from the base support 24. The leg elements 22 of the toy character 12 also extend as flexible cantilevers from the body 18. The leg elements 22 extend in the same plane as do the arm elements 20. The leg elements 22 are molded from the same flexible plastic as are the arm elements 20. Each of the legs elements 22 terminates at its free end with a flat footpad 32. The toy character 12 is symmetrically balanced so it can freely stand upright upon the flat footpads 32 when placed on a flat surface.

The leg elements 22 are long and thin. A slot 34 is present between the leg elements 22 that separates the leg elements 22 from each other. The leg elements 22 are reinforced by the body 18 of the toy character 12. The body 18 of the toy character 12 is molded to both the base support 24 and the higher sections of the leg elements 22. The presence of the body 18 stiffens the leg elements 22 and prevents the leg elements 22 from breaking away from the base support 24 when the leg elements 22 are temporarily deformed apart.

The clip base launcher 14 has the structure of a traditional female half of a clip connector with the exception that a separator plate 36 is added to its structure. The clip base launcher 14 has a housing 40. The separator plate 36 runs down the middle interior of the housing 40. The housing 40 has a face surface 42 FIG. 2), a rear surface 44 and two side surfaces 46 that define an interior 48. The two side surfaces 46 have slightly diverging paths as they travel toward the open top 50 of the housing 40. As such, the side surfaces 46 provide the interior 48 with a slightly V-shaped cross-sectional profile. The housing 40 has an open top 50 and two opposing side openings 52 in the side surfaces 46. The separator plate 36 is disposed midway between the side openings 52. The separator plate 36 lays perpendicular to both the face surface 42 and the rear surface 44 of the housing 40. The side openings 52 are disposed in the side surfaces 46 at a distance D1 from the open top 50. The distance D1 is equal or slightly shorter than the length L1 of the thin sections 26 of the arm elements 20 on the toy character 12.

Figure 4B:
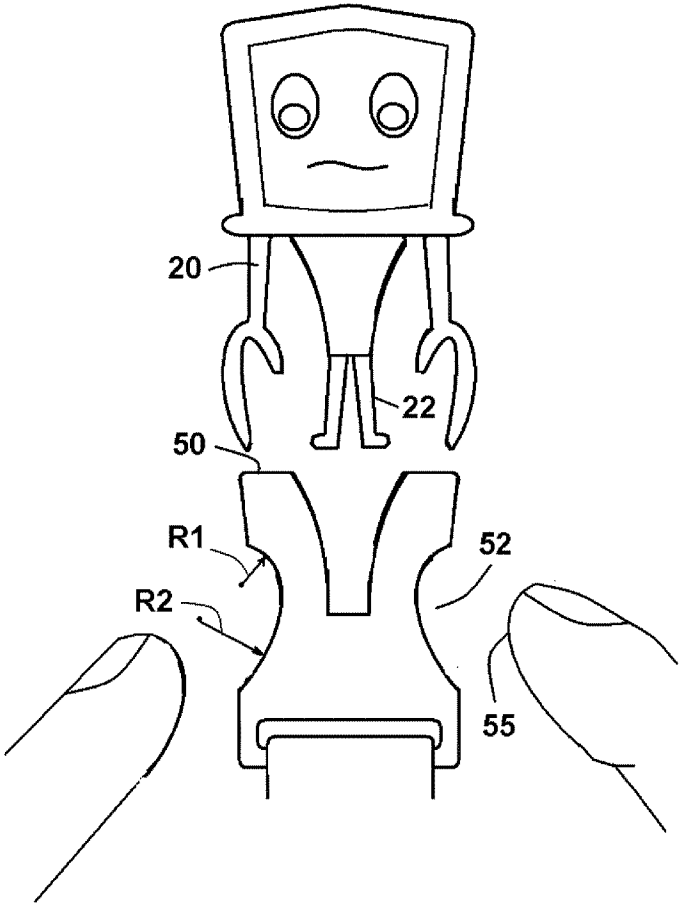
FIG. 4B shows an enlarged view of a side opening in the clip base launcher being engaged by a fingertip.
Figure 4A:
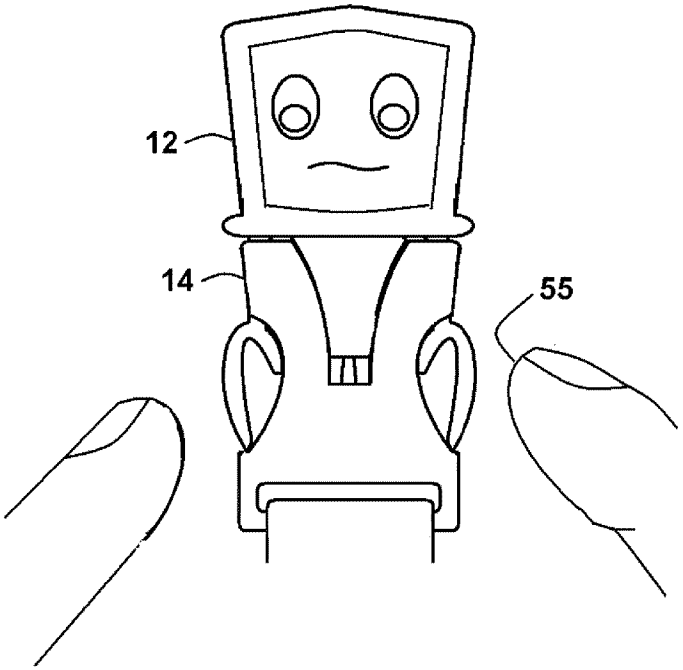
FIG. 4A shows an enlarged view of a side opening in the clip base launcher.

The side openings 52 are concave. Referring to FIGS. 4A and 4B in conjunction with FIG. 3, it can be seen that the side openings 52 have a complex shape with a first radius of curvature R1 and a second radius of curvature R2. The first radius of curvature R1 is smaller than the second radius of curvature R2. As a consequence, the side openings 52 have a steeper slope curvature at the end of the side openings 52 nearest the open top 50. The ends of the side openings 52 furthest from the open top 50 have a second slope curvature that is less steep. This difference in slope curvature serves an important function.

The differences in slope curvature cause a person's fingertip 55 to naturally enter the side openings 52 at a slight angle, rather than parallel to the open top 50. The angle directs the fingertip 55 slightly toward the open top 50 of the clip base launcher 14. As a result, the fingertips 55 not only compress the arm elements 20 toward each other, but they also press the arm elements 20 slightly forward. This slight forward movement begins to release the energy stored in the arm elements 20 and leg elements 22. As such, it begins a mechanical reaction that results in the toy character 12 being launched from the clip base launcher 14.

Figure 5:
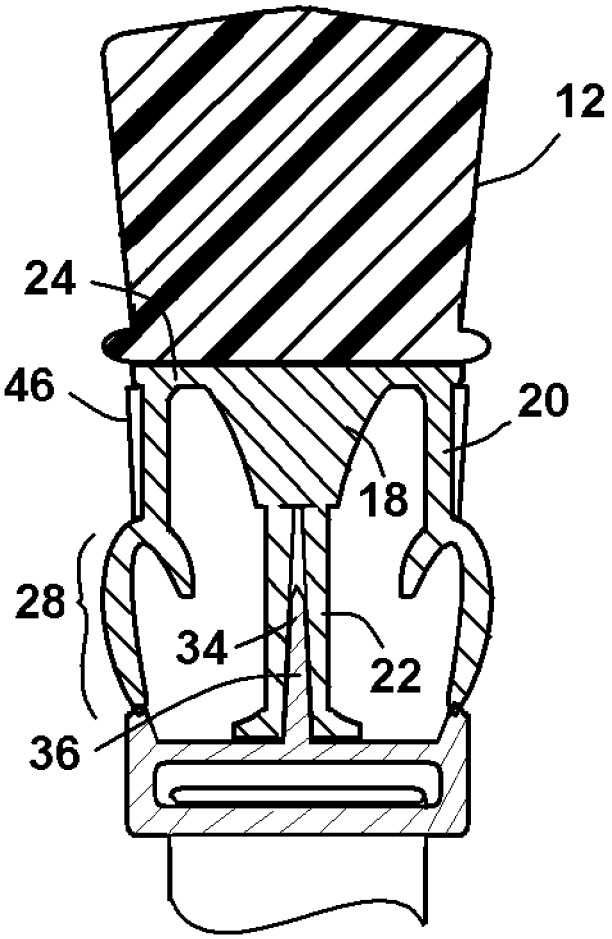
FIG. 5 shows a cross-sectional view of the embodiment of FIG. 2.

Referring to FIG. 5 in conjunction with FIG. 3, it will be understood that the toy character 12 and the clip base launcher 14 can be mechanically interconnected. The arm elements 20, leg elements 22, and body 18 of the toy character 12 pass into the open top 50 of the clip base launcher 14. As the arm elements 20 of the toy character 12 are advanced into the clip base launcher 14, the hand sections 28 contact the converging side surfaces 46. This deforms the arm elements 20 toward each other until the hand sections 28 of the arm elements 20 pass into the side openings 52. Once within the side openings 52, the arm elements 20 rapidly spread, causing the hand sections 28 to protrude through the side openings 52. Since the lengths of the thin sections 26 of the arm elements 20 has the same length as the side surfaces 46 above the side openings 52, the hand sections 28 expand into the side openings 52 just as the base support 24 abuts against the open top 50. At this position, the toy character 12 is fully seated within the clip base launcher 14.

Additionally, as the leg elements 22 of the toy character 12 advance into the clip base launcher 14, the slot 34 between the leg elements 22 aligns with the separator plate 36 within the clip base launcher 14. As the leg elements 22 further advance, the separator plate 36 passes into the slot 34 and creates a slight spreading of the leg elements 22. The spreading of the leg elements 22 stores spring energy in the leg elements 22. The spring energy stored increases until the toy character 12 is fully seated within the clip base launcher 14.

Referring to figures, it will be understood that in order to launch the toy vehicle 12 from the clip base launcher 14, the flexible arm elements 20 are pressed inwardly with a force sufficient to overcome the spring bias of the flexible arm elements 20. The application of the force causes the flexible arm elements 20 to disengage from the side openings 52. The inward pressing also further deforms the flexible arm elements 20 and causes them to store additional spring energy.

Once the flexible arm elements 20 have disengaged from the side openings 52 in the clip base launcher 14, the spring energy stored in the both the deformed arm elements 20 and the deformed flexible leg elements 22 biases the toy character up and out of the clip base launcher 14. Due to the curved surface 30 on each of the hand sections 28, and the angled slope of the side surfaces 46 on the interior of the housing 40, the stored spring energy acts to accelerate the toy character 12 away from the clip base launcher 14. This causes the toy character 12 to separate from the clip base launcher 14 and move away from the clip base launcher 14 at a significant velocity. Accordingly, the toy character 12 is propelled forward into flight.

It will be understood that the embodiment of the present invention that is shown is merely exemplary and variations can easily be made by those skilled in the art. For instance, the shape of the toy character can be changed as a matter of design choice. The toy character can also be configured as a plane, vehicle, missile, or similar traditional toy projectile shape. All such variations, modifications, and alternate embodiments are intended to be included within the scope of the present invention as defined by the claims.

What is claimed is:

1. A system for launching a toy character, said system comprising:

a toy character configured as a humanoid figure having a head with a face, a set of elongated arm elements and a set of elongated leg elements extending in a common direction away from said head, wherein said set of elongated arm elements terminate with hand sections and said toy character can freely stand upon said set of elongated leg elements;

said hand sections having curved exterior surfaces that bulge from said hand sections in opposite directions;

a clip connector housing having a top opening, side openings, an internal divider, and interior side surfaces that extend from said top opening to said side openings, wherein said interior side surfaces are set at a converging angle as said interior side surfaces extend from said top opening;

wherein said set of elongated arm elements and said set of elongated leg elements are inserted into said top opening of said clip connector housing to an engaged position;

wherein said curved exterior surfaces on said set of elongated arm elements are guided by said interior side surfaces toward said side openings and mechanically interlock with said side openings in said clip connector housing when in said engaged position;

wherein said set of leg elements are spread by said divider within said clip connector housing when in said engaged position; and wherein said set of elongated arm elements and said set of elongated leg elements store spring energy that releases to accelerate said toy character out and away from said clip connector housing when a force is applied to said set of elongated arm elements through said side openings that displaces said set of elongated arm elements from said side openings.

2. The system according to claim 1, wherein said set of elongated arm elements extend as cantilevers from said toy character.

3. The system according to claim 2, wherein said set of elongated leg elements extend as cantilevers from said toy character.

4. The system according to claim 3, wherein said set of elongated leg elements terminates with footpads and said toy character can stand freely on a surface with only said footpads contacting said surface.

5. The system according to claim 1, wherein said interior side surfaces each have a first length.

6. The system according to claim 1, wherein said set of elongated arm elements have thin sections that lead to said hand sections.

7. The system according to claim 1, wherein said side openings in said clip connector housing are concave and extend between a first end and a second end, wherein said first end is closer to said top opening than said second end, each of said side openings having a first slope curvature proximate said first end and a second slope curvature proximate said second end, wherein said first slope curvature is steeper than said second slope curvature.

8. The system according to claim 1, further including a flexible tether coupled to said clip connector housing.

9. A system for launching a toy projectile, said system comprising:

a toy projectile having an outside set of elongated elements and an inside set of elongated elements extending therefrom, wherein said inside set of elongated elements are disposed between said outside set of elongated elements;

said outside set of elongated elements having thin sections that lead into a wider sections at transition points, said wider sections having curved surfaces that bulge away from each other in opposite directions;

a clip connector housing having a top opening, side openings, an internal divider, and an internal side surfaces that extend from said top opening to said side openings;

wherein said internal side surfaces are set at a converging angle as said internal side surfaces extend from said top opening;

wherein said curved surfaces of said outside set of elongated elements and said inside set of elongated elements are inserted into said top opening of said clip connector housing;

wherein said curved surfaces of said outside set of elongated elements are guided by said internal side surfaces toward said side openings and transition points mechanically interlock with said side openings in said clip connector housing when in an engaged position;

wherein said inside set of elongated elements are spread by said divider within said clip connector housing when in said engaged position; and wherein said inside set of elongated elements and said outside set of elongated elements spring said toy projectile out and away from said clip connector housing when a force is applied to said outside set of elongated elements through said side openings that displaces said outside set of elongated elements from said side openings.

10. The system according to claim 9, wherein said outside set of elongated elements and said inside set of elongated elements are coplanar.

11. The system according to claim 9, wherein said toy projectile is configured as a toy character having a head and face, wherein said outside set of elongated elements are configured as arms to said toy character and said inside set of elongated elements are configured as legs to said toy character.

12. The system according to claim 11, wherein said inside set of elongated elements terminates with flat footpads and said toy projectile can stand freely on a surface with only said flat footpads contacting said surface.

13. The system according to claim 9, wherein said side openings in said clip connector housing are concave and extend between a first end and a second end, wherein said first end is closer to said top opening than said second end, each of said side openings having a first slope curvature proximate said first end and a second slope curvature proximate said second end, wherein said first slope curvature is steeper than said second slope curvature.

* * * * *